US007757779B2

(12) United States Patent
Jacobsson et al.

(10) Patent No.: US 7,757,779 B2
(45) Date of Patent: Jul. 20, 2010

(54) COMPRESSED AIR PERCUSSIVE MECHANISM FOR A DOWN HOLE HAMMER AND DOWN HOLE HAMMER

(75) Inventors: Torbjörn Jacobsson, Saltsjö-Boo (SE); Berndt Ekwall, Saltsjöbaden (SE)

(73) Assignee: Atlas Copco Secoroc AB, Fagersta (SE)

( * ) Notice: Subject to any disclaimer, the term of this patent is extended or adjusted under 35 U.S.C. 154(b) by 554 days.

(21) Appl. No.: 10/500,148

(22) PCT Filed: Nov. 29, 2002

(86) PCT No.: PCT/SE02/02207

§ 371 (c)(1),
(2), (4) Date: Apr. 4, 2005

(87) PCT Pub. No.: WO03/069109

PCT Pub. Date: Aug. 21, 2003

(65) Prior Publication Data

US 2005/0173158 A1 Aug. 11, 2005

(30) Foreign Application Priority Data

Jan. 23, 2002 (SE) ..... 0200181

(51) Int. Cl.
*B25B 9/04* (2006.01)
*B25B 9/08* (2006.01)

(52) U.S. Cl. ..... 173/17; 173/13; 173/137

(58) Field of Classification Search ..... 173/13–17, 173/137; 175/92, 296
See application file for complete search history.

(56) References Cited

U.S. PATENT DOCUMENTS

| | | | | | |
|---|---|---|---|---|---|
| 3,924,690 | A | | 12/1975 | Shaw | 173/13 |
| 4,102,534 | A | | 7/1978 | Benedict et al. | 173/137 |
| 4,821,812 | A | | 4/1989 | Ditzig | 173/17 |
| 4,921,052 | A | * | 5/1990 | Rear | 173/78 |
| 5,131,476 | A | * | 7/1992 | Harrington | 173/17 |
| 5,277,260 | A | | 1/1994 | Ranck | 173/17 |
| 5,566,771 | A | * | 10/1996 | Wolfer et al. | 175/296 |
| 5,685,380 | A | * | 11/1997 | Purcell et al. | 175/215 |
| 6,062,322 | A | * | 5/2000 | Beccu et al. | 173/91 |

FOREIGN PATENT DOCUMENTS

| | | |
|---|---|---|
| GB | 1419981 | 1/1976 |

* cited by examiner

*Primary Examiner*—Rinaldi I. Rada
*Assistant Examiner*—Lindsay Low
(74) *Attorney, Agent, or Firm*—Jacobson Holman PLLC

(57) ABSTRACT

Pressure-air driven percussion device for a down-the-hole drill with a hammer-piston which is axially reciprocally movable in a hammer-piston chamber through a driving device. The hammer-piston in operation acting with a hammer-end against an upper end of a drill bit which is positioned inside a chuck. An air-cushion for reducing percussive power is arranged to be formed at the hammer-end of the hammer-piston in positions where the drill bit has been moved past a predetermined distance in the percussion direction. The drill bit is sealingly slidingly supported in a drill bit bushing, and the hammer-end of the hammer-piston is formed so that it sealingly cooperates with the drill bit bushing in the positions in order to form the air-cushion.

8 Claims, 3 Drawing Sheets

COMPRESSED AIR PERCUSSIVE MECHANISM FOR A DOWN HOLE HAMMER AND DOWN HOLE HAMMER

This is a nationalization of PCT/SE02/02207 filed Nov. 29, 2002 and published in English.

FIELD OF THE INVENTION

This invention concerns a pressure-air percussion device according to the preamble of claim 1. The invention also concerns a down-the-hole drill including such a percussion device.

DESCRIPTION OF PRIOR ART

Down-the-hole drills are defined as drilling machines which are driven at the end of a drill pipe inside the borehole which is produced in the rock. A percussion device of a down-the-hole drill is driven by pressure fluid such as pressure-air which is supplied over the drill pipe from a pressure-air source inside the drilling rig of the percussion device. The percussion device includes a hammer piston which acts against a drill bit which through the percussive action disintegrates the rock into drill cuttings. This is subsequently brought out from the borehole through flushing with the pressure fluid.

In down-the-hole drills certain operational problems have been noticed in connection with the drill running across soft rock during the drilling process. This results in that the percussive energy transmitted to the drill bit tends to drive the drill bit out of its position in the drill bit chuck since the counteracting force from the rock is less than the percussive force.

This problem is solved according to the Canadian Patent document CA 982112 by the production of a pressure-air cushion in the area of the hammer-end of the hammer-piston in such positions where the drill bit advances, seen in the percussion direction, in front of an optimal operating position. In particular this is achieved by having the hammer-piston in corresponding advanced positions being in a position so as to cover sideward ports in a hammer-piston chamber which is defined by a sleeve.

With the aid of the established pressure-air cushion, the percussive energy against the drill bit is reduced in order to allow it to again be pressed into the drill bit holder at a sufficient extent by the counteracting force generated by the rock.

The solution suggested in this document is, however, because of its construction, insufficient to achieve a truly functional cushioning in softer rock.

AIM AND MOST IMPORTANT FEATURES OF THE INVENTION

It is an aim of this invention to provide a pressure-air driven percussion device as well as a down-the-hole drill wherein the problems of the prior art is eliminated or at least reduced.

In particular it is an aim to suggest a constructional simple and economically advantageous construction to effectively reduce the impact of the percussive energy transmitted to the drill bit in operative positions where the drill bit tends to be stricken out from the bore holder because the percussive energy of the hammer-piston is not sufficiently counteracted by counteracting forces from the meeting rock.

This aim is obtained according to the invention through the features of the characterising portion of claim 1.

Hereby it is achieved that an air-cushion is formed in a space which is possible to effectively seal with simple means. Said space further being constructed to provide a minimal dead volume, that is minimal remaining volume at the moment of the hammer-piston striking the drill bit, which results in a high degree of compression of the contained air and thereby effective cushioning.

Said dead volume is further reduced if an upper end region of the drill bit is sealingly supported in the drill bit bushing.

In particular it is preferred that the volume is defined by the upper end of the drill bit, the drill bit bushing and the hammer-end of the hammer-piston.

Further advantages are obtained through further aspects of the invention, which are apparent from the following description of embodiments.

BRIEF DESCRIPTION OF DRAWINGS

The invention will now be described by way of embodiments and with reference to the annexed drawings, wherein.

DESCRIPTION OF EMBODIMENT

Figure 1:
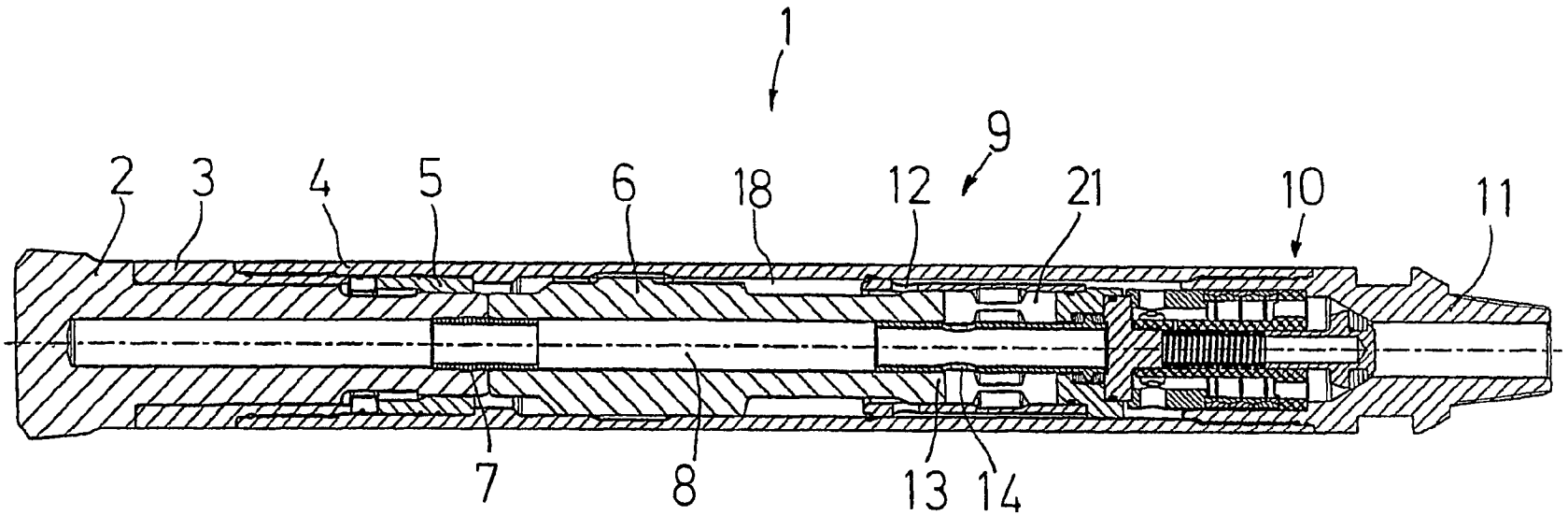
FIG. 1 shows an axial section of a down-the-hole drill according to the invention.

In FIG. 1, reference numeral 1 generally indicates a down-the-hole drill for pneumatic operation. A drill bit 2 is shown inserted in a drill chuck 3 which in turn is carried by a housing 4 of the down-the-hole drill 1. In the area of the upper end of the drill bit 2, there is, fixedly connected with the housing 4, a drill bit bushing 5, which is sealed against the housing 4 and essentially sealingly receives said upper end portion of the drill bit 2.

A hammer-piston 6 belonging to the percussion device of the down-the-hole drill 1 is shown in FIG. 1 in a normal percussion position at the instant when it strikes against the upper end of the drill bit 2. A sleeve-shaped foot valve 7 is fixedly connected to the drill bit 2 and extends axially upwards (to the right in FIG. 1) so that it also seals inwardly against a central axial channel 8, which goes through the hammer-piston 6 in its entire length. This axial channel 8 opens from the driving device of the down-the-hole drill 1, in general indicated with 9, and also goes through the drill bit 2 in order to end with a number (not shown in Fig.) of flushing holes which are intended to guarantee that disintegrated rock is brought away from the borehole.

The driving device 9 functions for axial downward driving of the hammer-piston 6, which by the way is driven in the upward direction, through system pressure acting in a hammer-piston chamber 18 against the lower part of the hammer-piston, when the upper chamber 21 of the driving device 9 (to the right in FIG. 1) is evacuated. This occurs when the upper end 13 of the hammer-piston 6 uncovers exit holes 14, which are arranged in a sealing pipe which is fastened to the upper part of the down-the-hole drill 1 and seals against the hammer-piston 6. Further, the down-the-hole drill 1 includes a valve device, in general indicated with 10, which comprises a one-way valve of the machine and an end part 11, to be fastened to drill piping in a manner known per se.

FIG. 1 also shows supply holes 12 which are preferably distributed around the envelope surface of a sleeve-shaped structure being included in the driving device 9. The reciprocal driving of the hammer-piston is, however, not part of this invention and is therefore not described in more detail here.

The driving device includes a leakage passage for pressure-air through which a flushing position is established. The pressure-air is allowed to leak past the driving device in advance positions in the percussion direction of the hammer-piston.

Figure 2:
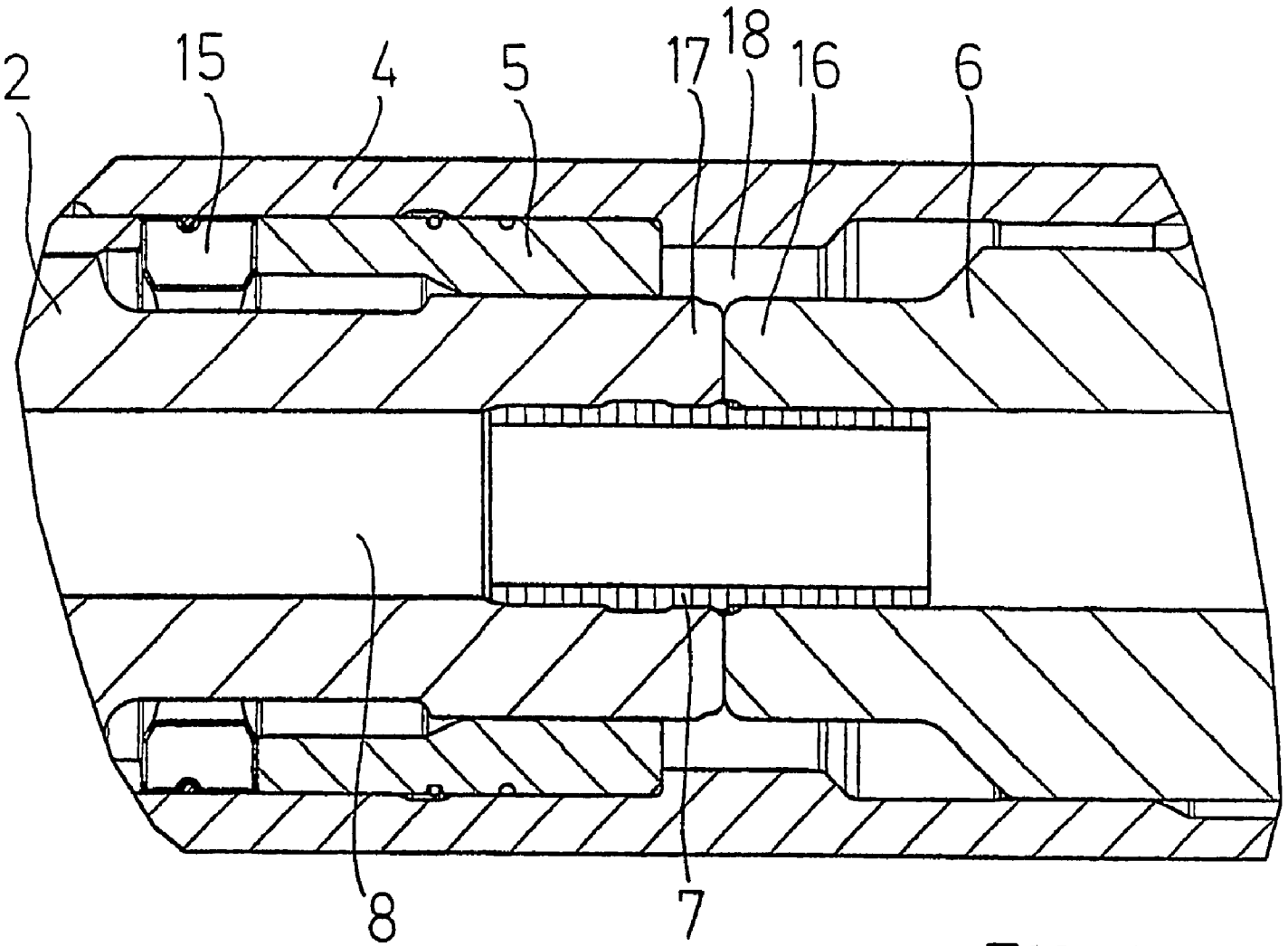
FIG. 2 shows in an enlarged scale a detail of the down-the-hole drill of FIG. 1 in a normal percussive position.

FIG. 2 shows in more detail the area of the percussion engagement between the hammer-piston 6 and the drill bit 2 with the upper end of the drill bit indicated with 17 and the hammer-end of the hammer-piston 6 indicated with 16. The hammer-piston chamber is indicated with 18. This figure also shows a retaining ring 15 the purpose of which is to prevent the drill bit 2 from completely leaving the chuck 3 of the down-the-hole drill 1. This is achieved through engagement cooperation between this retaining ring 15 and the radially protruding area of the upper end of the drill bit in case it would reach a far advanced position in the drill direction.

Figure 3:
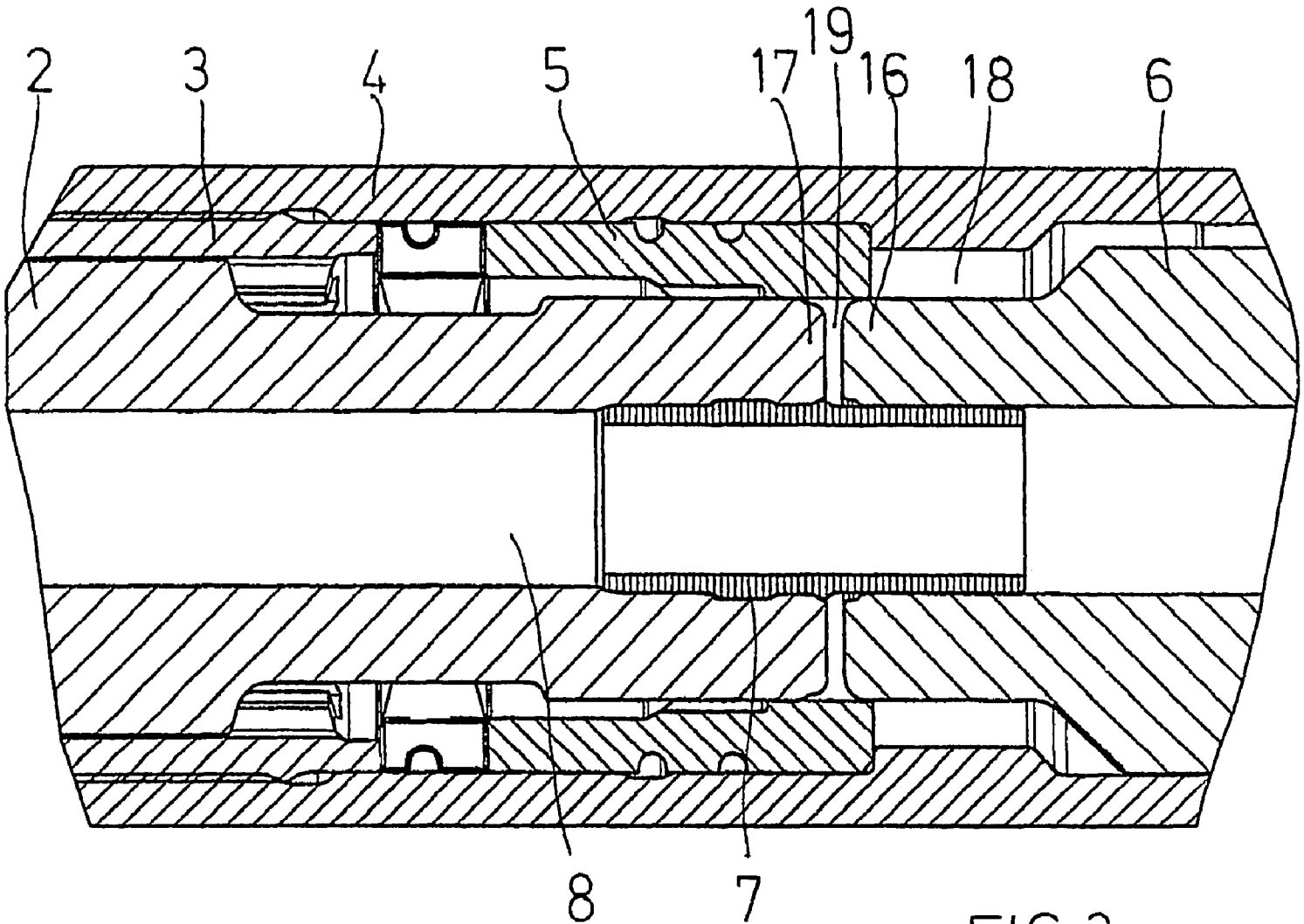
FIG. 3 shows, in a somewhat altered construction, the corresponding detail as in FIG. 2 but in a cushioning position.

FIG. 3 shows the area of FIG. 2 when the drill bit has moved axially somewhat to the left, as seen in the figure, that is in the direction out from the down-the-hole drill. This situation may occur, as has been indicated above, in soft rock, where the percussive energy exceeds the energy necessary to disintegrate met material. In this position the upper end 17 of the drill bit 2 will have been moved so that it is axially below the axially upper end of the drill bit bushing 5.

Hereby an annular space will be defined by these elements, which space will be closed so that it encloses a certain air volume when the hammer-piston 6 moves in a downward direction, and whereby the hammer-end 16 of the hammer-piston 6 will come to sealing fit with the inner upper axial end of the drill bit bushing 5.

This way a cushioning volume 19 will be established, which will enclose a certain amount of air having the system pressure of the device. Strikes performed by the hammer-piston 6 will now be effectively cushioned by the kinetic energy of the hammer-piston being absorbed and transmitted during an extended period of time, whereby the drill bit will be exposed to percussive energy peaks with less energy, resulting in that the counteracting force from also soft rock will be sufficient to reposition the drill bit to a more optimal percussive position.

This is ensured through the construction according to the invention which i.a. allows shaping the respective parts such that a small remaining volume, so called dead volume, remains at total impact between the hammer-piston and the drill bit. Altogether this results in that effective cushioning of the percussive effect can be achieved.

The movement of the hammer-piston 6 back to the upper position will be effected in a manner corresponding to what has been described above with reference to FIG. 1.

In an imagined case where the drill bit 2 is moved further to the left, as seen in FIG. 3 in the axial direction, the hammer-piston 6 will, during its movement, subsequently reach a position where the upper end 13 of the hammer-piston 6 (see FIG. 1) has reached a position axially below or, in the figure, to the left of the feeding holes 12. In this position a so called flushing position is reached, wherein no percussive effect whatsoever is performed by the percussion device of the down-the-hole drill 1. Instead the pressure-air supplied to the device will pass the feeding holes 12 above the upper end 13 of the hammer-piston 6 and be evacuated through the exit holes 14 in order to flush out through the not shown flushing holes in the drill bit 2. This flushing position gives further possibilities of repositioning the drill bit 2 to a normal percussion position.

It can also be mentioned that a separation of the drill bit from the hammer-piston a distance exceeding the length of the foot valve 7 which extends out from the drill bit would result in evacuating the hammer-piston chamber 18 through said foot valve 7 and the central channel 8.

The invention may be modified within the scope of the following claims. I.a. the drill bit 2 may be constructed differently and the drill bit bushing 5 may be positioned differently and possibly even be integrated in the housing 4 of the down-the-hole drill 1.

The hammer-piston 6 may be driven differently than what is shown in FIG. 1, that is the percussion device of the down-the-hole drill may be constructed in a different way.

It is also possible to construct a down-the-hole drill which is equipped according to the invention without a central axial channel. In that case channels for flushing may be arranged in the housing of the down-the-hole drill or between a housing and a lining. The cushioning chamber would in that case be limited only by the hammer-piston, the drill bit and the drill bit bushing.

The invention claimed is:

1. Pressure-air driven percussion device for a down-the-hole drill, the pressure-air driven percussion device comprising a hammer-piston axially reciprocally movable in a hammer-piston chamber through a driving device, said hammer-piston in operation acting with a hammer-end against an upper end of a drill bit positioned inside a chuck, a sealed air cushion for reducing percussive power, said sealed air cushion being arranged at the hammer-end of the hammer-piston in positions where the drill bit has been moved past a predetermined distance in a percussion direction, the drill bit being sealingly slidingly supported in a drill bit bushing, and the hammer-piston being movable inside the drill bit bushing and the hammer-end of the hammer-piston sealingly cooperating with the drill bit bushing in said positions to form said sealed air-cushion, said sealed air-cushion forming a sealed air volume defined vertically between an upper end of the drill bit and the hammer-end of the hammer-piston, with an outermost diameter of the hammer-end of the hammer-piston being located inside the drill bit bushing, and laterally by the drill bit bushing so that strikes performed by the hammer-piston against the upper end of the drill bit are cushioned by the sealed air-cushion and the drill bit is exposed to percussive energy peaks, prior to contact of the hammer-piston against the upper end of the drill bit.

2. Percussion device according to claim 1, wherein the upper end of the drill bit is sealingly, slidingly supported in the drill bit bushing.

3. Percussion device according to claim 1, wherein the drill bit bushing is arranged to be supported by a housing of the down-the-hole drill.

4. Percussion device according to claim 1, wherein the hammer-piston chamber is formed by a housing of the down-the-hole drill.

5. Percussion device according to claim 1, wherein the driving device includes a leakage passage for pressure-air through which a flushing position is established, and the pressure-air is allowed to leak past the driving device in advanced positions in the percussion direction of the hammer-piston.

6. Percussion device according to claim 1, wherein the hammer-piston is provided with a central axial channel which continues in the drill bit over a foot valve, which is fastened in the drill bit and seals against the hammer-piston.

7. Percussion device according to claim 6, wherein the air-cushion is limited by an outside surface of the foot valve.

8. Down-the-hole drill comprising a percussion device with a hammer-piston axially reciprocally movable in a hammer-piston chamber through a driving device, said hammer-piston in operation acting with a hammer-end against an upper end of a drill bit positioned inside a chuck, an air cushion for reducing percussive power arranged at the hammer-end of the hammer-piston in positions where the drill bit has been moved past a predetermined distance in a percussion direction, the drill bit being sealingly slidingly supported in a drill bit bushing, and the hammer-piston being movable inside the drill bit bushing and the hammer-end of the hammer-piston sealingly cooperating with the drill bit bushing in said positions to form said air-cushion, said air-cushion being arranged in a sealed air volume defined vertically between an upper end of the drill bit and the hammer-end of the hammer-piston, with an outermost diameter of the hammer-end of the hammer-piston being located inside the drill bit bushing, and laterally by the drill bit bushing so that strikes performed by the hammer-piston against the upper end of the drill bit are cushioned by the air-cushion and the drill bit is exposed to percussive energy peaks, prior to contact of the hammer-piston against the upper end of the drill bit.

* * * * *